United States Patent [19]

Zedrosser

[11] 4,191,089

[45] Mar. 4, 1980

[54] BREECH-CLOSING MECHANISM FOR AUTOMATIC RIFLE

[75] Inventor: Ulrich Zedrosser, Steyr, Austria

[73] Assignee: Steyr-Daimler-Puch-Aktiengesellschaft, Vienna, Austria

[21] Appl. No.: 895,270

[22] Filed: Apr. 10, 1978

[30] Foreign Application Priority Data

Dec. 22, 1977 [AT] Austria ..... 9204/77

[51] Int. Cl.[2] ..... F41D 3/06

[52] U.S. Cl. ..... 89/181; 89/185

[58] Field of Search ..... 89/164, 166, 172, 181, 89/185

[56] References Cited

FOREIGN PATENT DOCUMENTS 328336 5/1975 Austria .

*Primary Examiner*—Stephen C. Bentley

*Attorney, Agent, or Firm*—Kurt Kelman

[57] ABSTRACT

A breech-closing mechanism for an automatic rifle having a breech chamber and a first locking and stop device comprises a longitudinally movable slide formed with a cam slot, a second locking device rigid with a longitudinally slidably bolt mounted in the slide and rotatable relative thereto. A longitudinally movable locking member is non-rotatably mounted in the slide and a radial cam follower pin is rigid with the bolt and extends through an angled slot in the locking member into the cam slot. The locking member is spring-urged forwardly relative to the slide and is carried along by the slide into engagement with the first locking and stop device. The slide moves forwardly relative to the locking member against the spring force when the locking member is in said engagement until the pin is at the forward end of a longitudinal arm of the angled slot. The pin cooperates with the cam slot to transmit a longitudinal movement of the slide to the bolt when the pin extends through the arm and enters a transverse arm at the forward end to cooperate with the cam slot to move the bolt between first and second rotational positions.

2 Claims, 4 Drawing Figures

Figure 1:
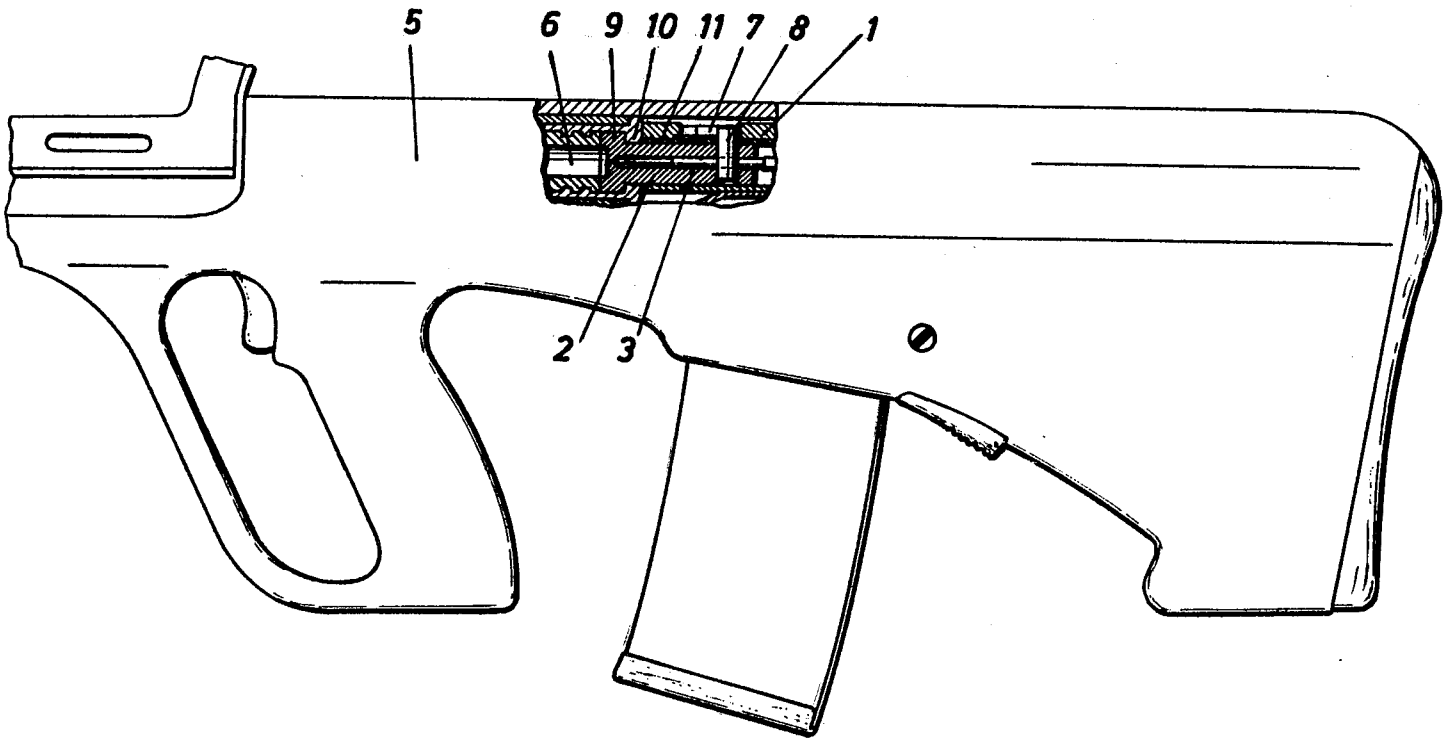

FIG. 2
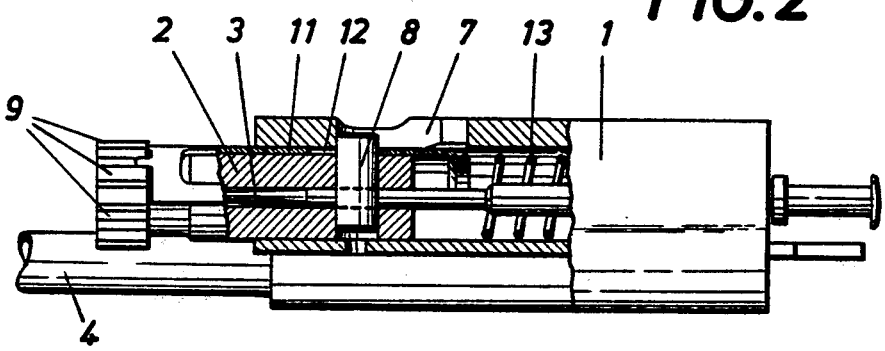
FIG. 3
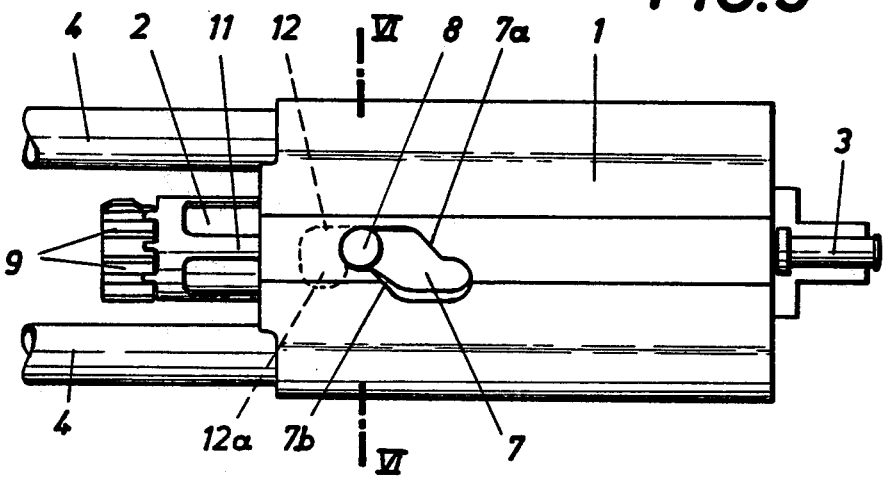
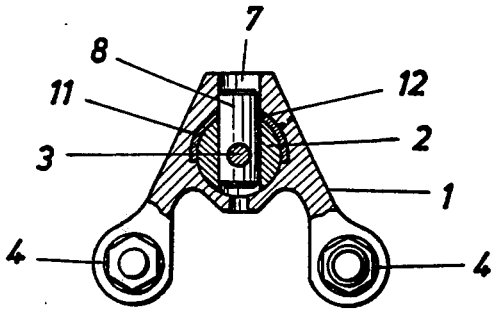
FIG. 4

BREECH-CLOSING MECHANISM FOR AUTOMATIC RIFLE

This invention relates to a breech-closing mechanism for automatic rifles, comprising a reciprocable slide and a bolt, which is mounted in said slide and contains a firing pin and during a displacement relative to the slide is rotatable by a cam and cam follower which cooperates with said cam to lock and unlock the bolt at the chamber. The mechanism comprises also a separate locking member, which is slidably guided in the slide and adapted to lock the bolt against rotation and during the forward movement of the slide is adapted to strike on a stop disposed near the chamber and thus to be forced out of its locking position against the force of a spring.

In a breech-closing mechanism of that kind, which is disclosed in Austrian Patent Specification No. 328,336, the locking member extends on one side into a longitudinal groove of the slide and is provided on the other side with a lug, which extends into an angled slot, which is formed in the bolt and has an arm that is parallel to the longitudinal groove and a transverse arm at the rear end of the parallel arm. The firing pin extends through the lug of the locking member and is biased by a return spring, which is coiled around the firing pin and serves also to bias the locking member forwardly. The cam is formed by helical surfaces of an aperture in the bolt and cooperates with a cam follower consisting of a cross-pin, which is inserted in the slide. Because the angled slot which receives the lug of the locking member is formed in the bolt and must not be spaced from the aperture defined by the helical surfaces, the bolt is relatively long and involves a high manuafacturing and material expenditure. Besides, the angled slot considerably reduces the strength of the bolt. Owing to the inevitable backlash, the forces exerted to move the locking member result in a certain canting thereof and, by means of the lug, in an unfavorable loading of the firing pin, which extends through the lug. Finally, the mechanism is not fully reliable. The locking member serves to prevent a rotation of the bolt during a major part of its movement because the locking ribs of the bolt cannot properly enter the locking grooves of the chamber when the bolt has been rotated. When the bolt has been unlocked in the chamber and dirt or ice prevent the locking member from entering the longitudinal arm of the angled slot, the lug will remain in the transverse arm of the angled slot and cannot prevent a displacement and rotation of the bolt and the slide relative to each other. Such relative displacement may be caused, e.g., by the rising movement of the cartridge. Owing to a restriction of space, e.g., the spring is often too weak to oppose an obstruction which is due to dirt, and there are no external restoring forces for pushing or turning back the bolt to the proper position relative to the slide. Finally, the use of the cam and cam follower for rotating the bolt relative to the slide involves a relative unfavorable leverage because the cam is formed by a helical surface at an aperture of the bolt and the cross-pin serving as a cam follower has a lever arm which is smaller in any case than the radius of the bolt.

It is known to provide the bolt with a pin, which extends through a guide slot of the slide and protrudes therefrom and is slidable in a longitudinal guiding groove formed in a separate breech housing. In that arrangement, the guide slot of the slide serves as a cam slot and the pin serves as a cam follower for rotating the bolt during its displacement relative to the slide. The pin extending into the longitudinal guiding groove of the breech housing holds the bolt also against rotation during the corresponding part of its displacement so that further locking means are not required. The longitudinal guiding groove is enlarged at its forward end to form a transverse groove so that the pin which has arrived at said forward end can be transversely moved and the bolt can be rotated so as to be locked or unlocked. A disadvantage of that arrangement resides in the need for a breech housing, which defines the longitudinal guiding groove and extends rearwardly throughout the range of movement of the breech-closing mechanism and considerably adds to the structural expenditure and the weight of the firearm. Besides, the pin of the bolt is always in sliding contact with that side face of the longitudinal guiding groove which holds said pin and the bolt against rotation so that said side face is subjected to increased wear and the total friction to be overcome during the breech movement is considerably increased. As a result a stronger closing spring and an increased servicing expenditure are required.

It is an object of the invention to eliminate these disadvantages and so to improve the breech-closing mechanism described first hereinbefore that there is no need for a separate breech housing, a compact bolt is provided, which can be made at low cost, the leverage of the parts for rotating the belt is improved and the reliability is increased.

This object is accomplished according to the invention in that the bolt carries a radial pin, which constitutes a cam follower and engages a cam slot in the slide, the locking member is formed with an angled slot, which has a longitudinal arm and a transverse forward arm and is adapted to receive the radial pin, the spring which biases the locking member is disposed outside the bolt and the rear end of the spring bears on the slide.

In accordance with the invention the pin serving as a cam follower for rotating the bolt during its displacement relative to the slide performs also the function of the lug of the locking member of the known design so that a simplified, more compact structure is obtained. This is due to the fact that the bolt need not be formed with an angled slot, which adds to the length of the bolt and weakens the same and requires a separate milling operation. The angled slot is now formed in the locking member so that it can be made more easily and does not weaken a main part of the breech-closing mechanism. Because the spring which biases the locking member is disposed outside the bolt and the rear end of the spring bears on the slide, said spring may be larger so that it can better oppose a jamming of the bolt. Besides, an external restoring force is exerted on the bolt by the locking members and pin and ensures a forward displacement of the bolt relative to the slide and a resulting rotation of the bolt to the proper position for being locked, even when unusual influences have disabled the locking member during the return movement of the breech-closing mechanism. Because the cam follower consists of the radial pin and cooperates with the cam slot in the slide at a point which is spaced from the axis of the bolt by a distance which greatly exceeds the radius of the bolt, a favorable leverage is ensured for the rotation of the bolt for locking and unlocking the same in comparison to the known design comprising helical cam surfaces defining an aperture in the bolt. On the other hand, there is no need for a separate breech housing because the locking member is mounted in the slide.

According to a further feature of the invention the rear helical surface of the cam slot is spaced from the forward helical surface of the slot by approximately one and a half times the pin diameter. As a result, the bolt when it has just been unlocked is displaced to some extent relative to the slide so that the pin reliably enters the longitudinal arm of the angled slot. This may be particularly significant in case of a breakage of the spring.

An embodiment of the invention is shown by way of example on the drawing, in which FIG. 1 is a partly sectional view showing the significant parts of an automatic rifle, FIG. 2 is a side elevation showing partly insection the breech-closing mechanism on a larger scale, FIG. 3 is a top plan view coordinated with FIG. 2 and FIG. 4 is a transverse sectional view taken on line IV—IV in FIG. 3.

The breech-closing mechanism essentially comprises a slide 1 and a bolt 2, which is mounted in the slide and contains a firing pin 3. The slide 1 is provided with protruding guide tubes 4 (FIGS. 2 to 4), which are slidably mounted in mating slide bushings of the central part 5 of the rifle so that the slide 1 can move to and from the breech chamber 6.

The slide is formed with a cam slot 7 and the bolt 2 carries a cam follower, which consists of a radial pin 8 extending into the cam slot 2. The bolt 2 is provided at its forward end with locking ribs 9, which when the breech is closed lie before locking ribs 10 in the chamber 6 and can move through grooves between these ribs 10 when the bolt has been rotated.

When a shot has been fired, the slide 1 is first returned alone under the gas pressure by means of a mechanism which is not shown. Because the pin 8 engages the cam slot 7, the displacement of the slide 1 relative to the bolt 2 results in a rotation of the latter so that the locking ribs 9 can enter the grooves between the ribs 10 and the bolt 2 is thus released to leave the chamber 6. The slide 1 and bolt 2 now return in unison. When a forward movement is imparted to the slide 1 and bolt 2 by closing springs disposed in the guide tubes 4, operations described above are performed in a reversed sequence to lock the bolt.

To prevent a rotation of the bolt 2 relative to the slide 1 when such rotation is not required to lock the bolt in or unlock it from the chamber 6, a locking member 11 is provided, which is approximately semicircular in cross-section and has apertures in order to reduce its weight. The locking member 11 is slidably mounted on the bolt 2 and encloses one half of the periphery of the latter and is non-rotatably guided in the slide 1, as is particularly apparent from FIG. 4. The locking member 11 has an angled slot 12, through which the radial pin 8 extends and which has a longitudinal arm and a forward transverse arm 12*a* (indicated in dotted lines in FIG. 3). The locking member 11 is biased by a compression spring 13 (FIG. 2), which is disposed outside the bolt 2. The rear end of the spring 13 bears on the slide 1. In the position shown in FIGS. 2 and 3, the locking member 11 prevents a rotation of the bolt 2 relative to the slide 1 because the pin 8 extends through the longitudinal arm of the angled slot 12 and the locking member 11 is nonrotatably guided in the slide 1. When the locking member 11 strikes the rear end face of the ribs 10 during the advance of the entire breech-closing mechanism 1, 2, the locking member 11 cannot advance further with the bolt 2 and the pin 8 enters the transverse arm 12*a* of the angled slot 12 and cooperates with the cam slot 7 to rotate the bolt 2 so that it is locked at the chamber 6. It is apparent that the pin 8 has a dual function as it serves as a cam follower cooperating with the cam slot 7 and also cooperates with the angled slot 12 of the locking member for a locking action. It is shown in FIG. 3 that the distance from the rear helical surface 7*a* of the cam slot 7 to its forward helical surface 7*b* is about one and a half times the diameter if the pin 8.

What is claimed is:

1. In an automatic rifle having a breech chamber and first locking and stop means near said chamber, the provision of a breech-closing mechanism, which comprises a slide, which is longitudinally movable relative to said chamber and formed with a cam slot, a bolt, which is longitudinally slidably mounted in said slide and rotatable relative to said slide between first and second rotational positions, second locking means rigid with said bolt and adapted to cooperate with said first locking and stop means so that a longitudinal movement of said second locking means past said first locking and stop means is permitted in said first and prevented in said second rotational position of said bolt, a locking member non-rotatably mounted in said slide and extending between said slide and bolt and longitudinally movable relative to said slide and bolt and formed with an angled slot having a longitudinally extending arm and at the forward end of the latter a transverse arm, a radial cam follower pin rigid with said bolt and extending through said angled slot into said cam slot and a spring which is disposed outside said bolt and interposed between said slide and said locking member and urges said locking member forwardly relative to said slide, said locking member being adapted to be carried along by said slide forwardly into engagement with said first locking and stop means, said slide being adapted to move forwardly relative to said locking member against the force of said spring when said locking member engages said first locking and stop means until said pin is at the forward end of said longitudinal arm, said pin being adapted to cooperate with said cam slot to transmit a longitudinal movement of said slide to said bolt when said pin extends through said longitudinal arm and being adapted to enter said transverse arm from the forward end of said longitudinal arm and to cooperate with said cam slot so as to move said bolt between said first and second positions in response to a longitudinal movement of said slide when said pin extends through said transverse arm

2. A breech-closing mechanism as set forth in claim 1, in which said cam slot has forward and rear helical surfaces, which are spaced apart by about one and a half times the diameter of said pin.

* * * * *